US012778234B2

(12) United States Patent
Levesque et al.

(10) Patent No.: US 12,778,234 B2
(45) **Date of Patent: *Nov. 3, 2026**

(54) CONNECTOR FOR ELECTRICAL VISOR AND A VISOR ASSEMBLY AND A HELMET HAVING THE SAME

(71) Applicant: KIMPEX INC., Drummondville (CA)

(72) Inventors: Jean-Simon Levesque, Victoriaville (CA); Frederic Rene-Laforest, Drummondville (CA); Patrick L'Hérault, Saint-Marjorique (CA); Stephane Dion, Granby (CA)

(73) Assignee: KIMPEX INC., Drummondville (CA)

( * ) Notice: Subject to any disclaimer, the term of this patent is extended or adjusted under 35 U.S.C. 154(b) by 0 days.

This patent is subject to a terminal disclaimer.

(21) Appl. No.: 19/261,327

(22) Filed: Jul. 7, 2025

(65) Prior Publication Data

US 2025/0331596 A1 Oct. 30, 2025

Related U.S. Application Data

(63) Continuation of application No. 18/109,544, filed on Feb. 14, 2023, now Pat. No. 12,369,670.
(Continued)

(51) Int. Cl.
*A42B 3/22* (2006.01)

(52) U.S. Cl.
CPC ..... *A42B 3/224* (2013.01)

(58) Field of Classification Search
CPC .. A42B 3/24; A42B 3/245; A42B 3/22; A42B 3/221
See application file for complete search history.

(56) References Cited

U.S. PATENT DOCUMENTS 4,584,721 A * 4/1986 Yamamoto ..... A42B 3/245 219/203
4,682,007 A * 7/1987 Hollander ..... A42B 3/245 219/203
(Continued)

FOREIGN PATENT DOCUMENTS

CA 2213803 C 10/2000
CA 3080021 A 11/2021
(Continued)

*Primary Examiner* — Jillian K Pierorazio
(74) *Attorney, Agent, or Firm* — Benesch Friedlander Coplan & Aronoff LLP

(57) ABSTRACT

A visor assembly of a helmet having a helmet shell is provided. The visor assembly includes a visor pivotally connectable to the helmet shell via left and right visor mounting sections. The visor has an inner surface facing a cavity of the helmet shell and an outer surface, and is provided with a heating system. The visor assembly further has a connection assembly including an electrical connector located on the outer surface of the visor proximate a front portion thereof. The electrical connector is operatively connected to the heating system and is adapted to be connected to a power cable for providing electrical power to the heating system. The visor assembly also includes a cable retaining element located on the outer surface of the visor proximate one of the visor mounting sections. The cable retaining element has a clip adapted to removably attach the power cable on the visor.

20 Claims, 7 Drawing Sheets

Related U.S. Application Data

(60) Provisional application No. 63/268,149, filed on Feb. 17, 2022.

(56) References Cited

U.S. PATENT DOCUMENTS

| | | | | |
|---|---|---|---|---|
| 4,729,132 | A | 3/1988 | Fierro | |
| 4,996,981 | A * | 3/1991 | Elenewski | H01M 50/569 128/201.15 |
| 5,023,023 | A * | 6/1991 | Elenewski | B32B 17/10376 264/510 |
| 5,500,953 | A * | 3/1996 | Reuber | A42B 3/245 2/9 |
| 5,525,989 | A * | 6/1996 | Holt | G01S 7/022 342/20 |
| 5,694,650 | A * | 12/1997 | Hong | A42B 3/28 2/435 |
| 6,417,491 | B1 | 7/2002 | Taniuchi | |
| 7,076,279 | B2 | 7/2006 | Tabata et al. | |
| 7,264,479 | B1 | 9/2007 | Lee | |
| 7,303,302 | B2 * | 12/2007 | Harris | A42B 3/0406 362/802 |
| 8,585,256 | B2 | 11/2013 | Chen | |
| 9,655,784 | B2 * | 5/2017 | North | A61F 9/06 |
| 10,413,010 | B2 | 9/2019 | Dutour et al. | |
| 10,980,308 | B2 | 4/2021 | Dutour | |
| 11,096,440 | B2 | 8/2021 | Tsai | |
| 11,109,625 | B1 * | 9/2021 | Avasarala | A41D 13/1138 |
| 11,266,198 | B2 | 3/2022 | Demers et al. | |
| 11,382,379 | B2 | 7/2022 | Dutour et al. | |
| 11,382,380 | B2 | 7/2022 | Dutour et al. | |
| 2006/0232955 | A1 | 10/2006 | Labine | |
| 2008/0290081 | A1 * | 11/2008 | Biddell | A42B 3/245 219/203 |
| 2011/0105013 | A1 | 5/2011 | Tseng | |
| 2013/0229812 | A1 * | 9/2013 | Chen | A42B 3/245 362/362 |
| 2017/0215510 | A1 | 8/2017 | Demers et al. | |
| 2019/0000674 | A1 * | 1/2019 | Bouchard Fortin | A42B 3/185 |
| 2019/0222912 | A1 * | 7/2019 | Topay | H04R 1/1041 |
| 2019/0365010 | A1 | 12/2019 | Dutour et al. | |
| 2021/0282493 | A1 * | 9/2021 | Dutour | A42B 3/245 |
| 2022/0214567 | A1 * | 7/2022 | Berg | G02C 11/10 |
| 2022/0225705 | A1 * | 7/2022 | Van Straten | A41D 13/1161 |
| 2022/0304413 | A1 | 9/2022 | Dutour et al. | |

FOREIGN PATENT DOCUMENTS

| | | | |
|---|---|---|---|
| CH | 636251 | A1 | 5/1983 |
| KR | 100650102 | B1 | 11/2006 |
| TW | M479547 | U | 6/2014 |

* cited by examiner

CONNECTOR FOR ELECTRICAL VISOR AND A VISOR ASSEMBLY AND A HELMET HAVING THE SAME

CROSS-REFERENCE TO RELATED APPLICATIONS

This application is a continuation of U.S. patent application Ser. No. 18/109,544, filed Feb. 14, 2023 and entitled "CONNECTOR FOR ELECTRICAL VISOR AND A VISOR ASSEMBLY AND HELMET HAVING THE SAME," which application claims the benefit of U.S. Provisional Application No. 63/268,149, filed on Feb. 17, 2022 and entitled "CONNECTOR FOR ELECTRICAL VISOR AND A VISOR ASSEMBLY AND A HELMET HAVING THE SAME," which are incorporated by reference herein in their entireties.

TECHNICAL FIELD

The technical field generally relates to protective helmets, and more specifically to a helmet provided with a visor having an integrated cable alignment element for attaching a cable to the visor.

BACKGROUND

Helmets used for outdoors activities, and particularly motorized activities, generally comprise visors for protecting the wearer's face from wind, bugs, branches, etc. Depending on the conditions in which those activities are meant to be practiced, various devices, systems and/or amenities can be provided within or on the helmets to enhance the experience of the user. For example, helmets especially designed for snowmobile use can be provided with heating systems to prevent fog from building up inside the visor. Such devices generally require electrical power to function. In such cases, a power cable generally needs to be connected between the power source and the powered systems of the helmet. Typically, the power cable is loosely connected to the helmet and wiring is necessary between the helmet and the visor, to power the heating system. The power cable can be prone to accidental disconnection which can damage other components, including the electrical connections.

Therefore, there is a need for an improved system for powering a visor and for power cable management.

SUMMARY

According to an aspect of the present disclosure, there is provided a visor assembly of a helmet. The helmet has a helmet shell defining a cavity. The visor assembly includes a visor pivotally connectable to the helmet shell via left and right visor mounting sections, the visor having an inner surface facing the cavity of the helmet shell and an outer surface opposite the inner surface. The visor is provided with a heating system. The visor assembly also includes a connection assembly comprising an electrical connector located on the outer surface of the visor proximate a front portion thereof, the electrical connector being operatively connected to the heating system and being adapted to be connected to a power cable for providing electrical power to the heating system. The visor assembly further includes a cable retaining element located on the outer surface of the visor proximate one of the left and right visor mounting sections, the cable retaining element having a clip adapted to removably attach the power cable on the visor.

According to a possible embodiment, the clip of the cable retaining element has a first portion having a first end and extending in a first direction substantially oriented toward the connection assembly such that a first section of the power cable extends from the first end of the clip and toward the front portion of the visor in general alignment with the electrical connector.

According to a possible embodiment, the cable retaining element is integrated to the visor to form a one-piece unit.

According to a possible embodiment, the clip includes a second portion having a second end, and wherein the first portion and the second portion together define a hook-shaped channel, the second portion extending in a second direction at an angle relative to the first direction, and wherein the hook-shaped channel is adapted to receive and redirect the power cable into the general alignment with the electrical connector.

According to a possible embodiment, the clip is made of a resilient material.

According to a possible embodiment, the hook-shaped channel is arcuate, and the power cable is redirected through the channel into the general alignment with the electrical connector.

According to a possible embodiment, the clip comprises a first portion and the second portion of the clip are spaced from one another, and wherein the wherein the hook-shaped channel extends between the first and second portions.

According to a possible embodiment, the first portion of the clip is adapted to position the first section of the power cable such that a disconnection force applied to the power cable defines a force axially aligned with the connection assembly in order to at least partially prevent damaging one of the first section of the power cable and the connection assembly.

According to a possible embodiment, the clip is adapted to enable slidably connecting the power cable thereto, and the first and second portions of the clip are adapted to generate friction forces on the power cable upon the application of a disconnection force thereon to at least partially prevent disconnection of the power cable from the connection assembly.

According to a possible embodiment, the visor assembly further comprises a continuous sealing member provided on the inner surface of the visor and extending along a general periphery of the front portion thereof to define a sealed area, the connection assembly being located within the sealed area.

According to a possible embodiment, the cable retaining element is located outside of the sealed area.

According to a possible embodiment, the visor comprises an aperture located within the sealed area adapted to enable operatively connecting the electrical connector to the heating system.

According to a possible embodiment, the heating system comprises at least one of one or more conductive elements, a conductive membrane and a resistive coating.

According to a possible embodiment, the heating system comprises at least one electrical prong extending from the outer surface of the visor, the connection assembly being connected to the at least one electrical prong.

According to a possible embodiment, the connection assembly is magnetically connected to the at least one electrical prong.

According to a possible embodiment, the visor assembly further comprises a status indicator adapted to visually display a status indicative of an activation of the heating system.

According to a possible embodiment, the status indicator is operatively connected to the connection assembly and located toward the front portion of the visor.

According to a possible embodiment, the status indicator at least partially faces the cavity of the helmet shell to enable visual confirmation by a user wearing the helmet of the status indicative of the activation of the heating system.

According to a possible embodiment, the status indicator is positioned in line of sight of a user wearing the helmet when the visor is in a lowered position.

According to a possible embodiment, the status indicator includes at least one light-emitting diode (LED).

According to a possible embodiment, the connection assembly further comprises a control button operatively connected to the heating system, the control button is configured to control at least one of an activation of the heating system, a mode of the heating system, an intensity of the heating system, and an electrical power transmitted to the heating system.

According to a possible embodiment, the connection assembly further comprises a lighting element adapted to project light outwardly from the outer surface of the visor.

According to a possible embodiment, the electrical connector further comprises a magnetic connection adapted to enable magnetically connecting with the power cable According to another aspect, there is provided a helmet. The helmet includes a helmet shell defining a cavity for receiving a wearer's head, and the visor assembly according to any one of the embodiments described herein.

According to a possible embodiment, the power cable comprises a first end removably connectable to the connection assembly and a second end removably connectable to a power source.

According to another aspect, there is provided a visor assembly of a helmet having a helmet shell defining a cavity. The visor assembly includes a visor pivotally connected to the helmet shell via left and right visor mounting sections, the visor having an inner surface facing the cavity of the helmet shell and an outer surface opposite the inner surface, the inner surface being provided with a heating system. The visor assembly also includes a connection assembly comprising an electrical connector located on the outer surface of the visor proximate a front portion thereof, the electrical connector being operatively connected to the heating system and being adapted to be connected to a power cable for providing electrical power to the heating system.

According to a possible embodiment, the visor assembly further includes a cable retaining element located on the outer surface of the visor proximate one of the left and right visor mounting sections. The cable retaining element includes a clip adapted to removably attach the power cable on the visor, the clip having a first portion extending in a first direction toward the connection assembly such that a first section of the power cable extends from the first portion of the clip and toward the front portion of the visor in general alignment with the electrical connector to facilitate connection therewith.

According to another aspect, there is provided a visor assembly of a helmet having a helmet shell defining a cavity. The visor assembly includes a visor pivotally connected to the helmet shell, the visor having an inner surface facing the cavity of the helmet shell and an outer surface opposite the inner surface, the inner surface being provided with a heating system. The visor assembly further includes a connection assembly comprising an electrical connector located on the outer surface of the visor proximate a front portion thereof, the electrical connector being operatively connected to the heating system and adapted to be connected to a power cable for providing electrical power to the heating system. The visor assembly also includes a sealing member provided on the inner surface of the visor and extending generally along a periphery thereof to define a sealed area of the visor, wherein the connection assembly is located within the sealed area.

According to a possible embodiment, the visor assembly further includes a cable retaining element located on the outer surface of the visor outside of the sealed area, the cable retaining element having a clip adapted to removably attach the power cable on the visor.

DETAILED DESCRIPTION

As will be described herein, a helmet having a helmet shell and a visor assembly is provided. The visor assembly includes a visor, a connection assembly and an integrated cable alignment element (which can also be referred to as a cable retaining element). The connection assembly allows for electrical power to be provided directly to the visor, for example, to power a heating system. The cable alignment element is adapted to reduce the risks of the connection assembly sustaining damages from shearing/tearing forces applied to the cable, for example, when the cable is accidentally ripped away from the helmet. As will be described further below, the cable alignment element is configured to at least partially redirect the forces applied to the cable (e.g., when the cable is accidentally tugged or ripped away) into a force generally axially aligned with the connection assembly.

As will also be described herein, the visor assembly can have a sealing member defining a sealed area, with the connection assembly being located within the sealed area. The location of the connection assembly within the sealed area allows for a continuous sealing member, e.g., with no discontinuities along the sealing member, by providing the electrical power to the visor from within the sealed area. The continuous sealing member allows for a high sealing efficiency and an improved leaking control compared to discontinuous sealing members.

Figure 1:
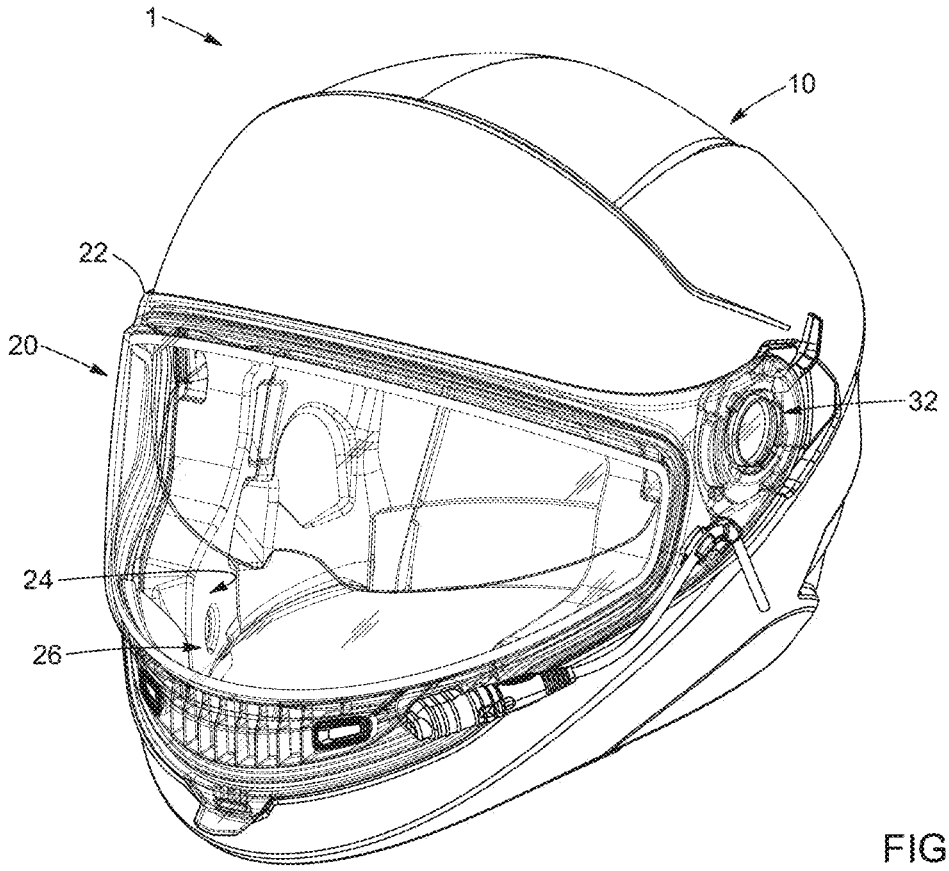
FIG. 1 is a perspective view of a helmet comprising a helmet shell and a visor assembly, according to an embodiment.

Referring to FIG. 1, a helmet 1 having a visor assembly 20 is shown. The helmet 1 includes a helmet shell 10 defining a cavity adapted to receive a head of a user wearing the helmet. The helmet shell further defines a frontal aperture defining a field-of-view allowing the user to see outwardly from the helmet, the field-of-view generally corresponding to the visible area which can be seen by the user wearing the helmet. The visor assembly 20 is configured to be pivotally connectable to the helmet shell 10 for selectively covering the frontal opening. In other words, the visor assembly 20 can be operated (e.g., moved) between a lowered/closed position to cover and substantially seal the frontal opening, and a raised/open position.

In some embodiments, the visor assembly 20 includes left and right visor mounting sections 32 (also seen in FIGS. 3 and 7) adapted to cooperate with corresponding helmet mounting assemblies located on the helmet shell 10. The visor assembly 20, when connected to the helmet shell 10, can be configured in a lowered configuration and at least one raised configuration. In the lowered configuration, the visor assembly 20 substantially covers the frontal aperture of the helmet shell 10, thereby protecting the face of the user. In the at least one raised configuration, the visor assembly 20 at least partially moves away from the frontal aperture. The visor assembly includes a visor 22 having an inner surface 24 facing the cavity of the helmet shell 10, and an outer surface 26 opposite the inner surface 24, facing outwardly from the helmet 1. In some embodiments, the visor mounting sections 32 are provided at opposite lateral ends of the visor 22, as seen in FIG. 3, for example.

Figure 2:
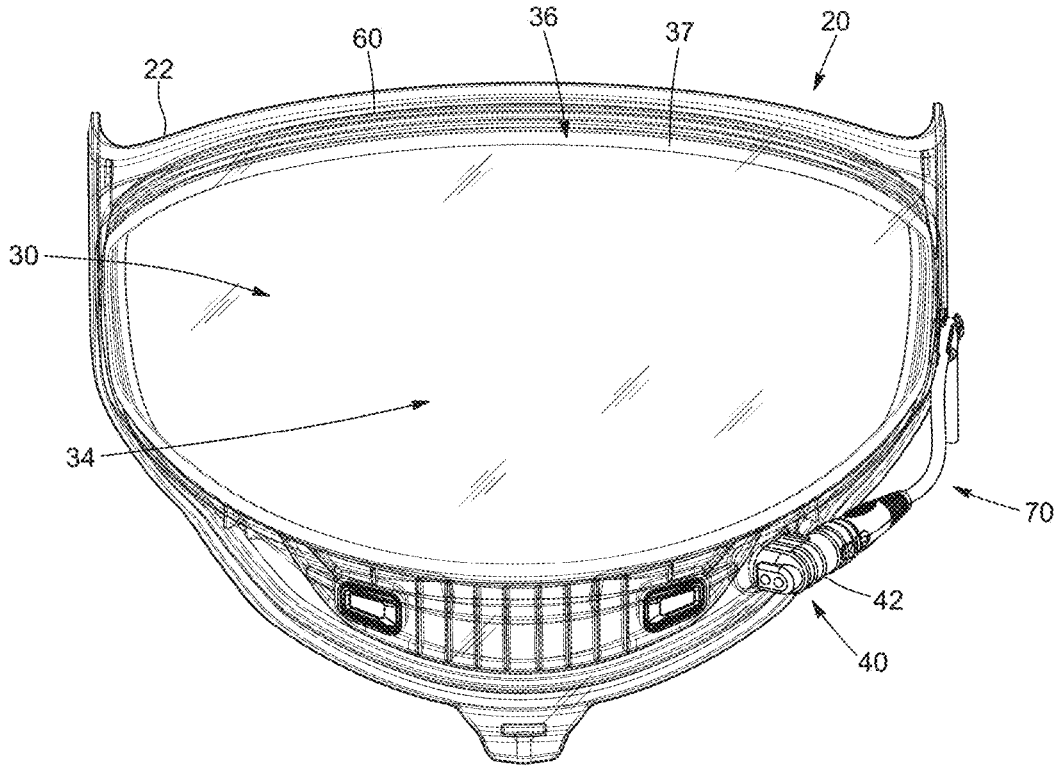
FIG. 2 is a frontal view of the visor assembly shown in FIG. 1, according to a possible embodiment.
Figure 3:
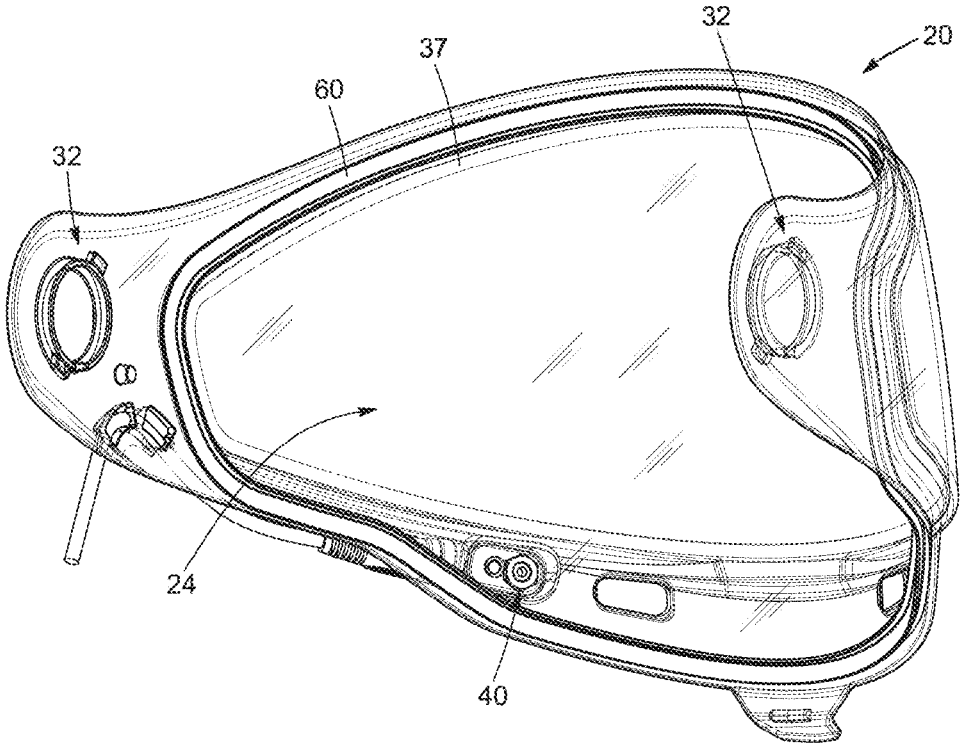
FIG. 3 is an inner perspective view of the visor assembly shown in FIG. 2, showing an electrical connection extending through an opening of the visor, according to an embodiment.

With reference to FIGS. 2 and 3, the visor 22 has a front portion 34 generally complementary with the frontal aperture of the helmet shell when the visor assembly is in the lowered configuration. It should thus be noted that the front portion 34 of the visor 22 can be in the field of view of the user when the visor 22 is lowered in front of the frontal opening (e.g., the user can look through the front portion 34 of the visor 22 when wearing the helmet). In some embodiments, the visor assembly 20 can be provided with a heating system 36 adapted to generate heat and at least partially reduce potential fogging of the visor assembly 20 (e.g., along the inner surface 24 of the visor 22). The heating system 36 can be adapted to heat the front portion 34 of the visor 22, although it is appreciated that other portions of the visor assembly 20 can also be heated via the heating system 36. Further, it should be noted that various electrical devices can be provided instead or in addition to the heating system 36.

In some embodiments, the heating system 36 can include one or more conductive elements 37 adapted to generate and/or dissipate energy as heat. As seen in FIGS. 2 and 3, the heating system 36 includes a strip of conductive element 37 provided along a top portion of the visor 22 such that heat can be provided to the visor 22. In some embodiments, the heating system 36 can include a conductive membrane and/or a resistive coating, for example, provided on the visor 22. The conductive membrane can be configured to assist in dissipating the heat generated by the conductive element 37 across a greater surface area of the visor 22, such as along the inner surface, the outer surface, or both. The heating system 36 can be powered by a power source external to the helmet, such as a battery of a snowmobile or a battery attached to the helmet, among other possibilities, and as will be described further below.

In this embodiment, the visor assembly 20 includes a sealing member 60 provided on the inner surface 24 of the visor 22. The sealing member 60 is adapted to at least partially prevent fluid leaks (e.g., air, water, etc.) from and/or into the helmet through the frontal opening, when the visor assembly 20 is in the lowered configuration. As seen in FIG. 2, the sealing member 60 can be made of a continuous element extending along a periphery of the front portion 34 of the visor 22, thereby defining a sealed area 30 of the inner surface 24. It is thus noted that the sealed area 30 can generally correspond to the field-of-view of the user wearing the helmet. Alternatively, it is appreciated that the sealed area can correspond to a smaller or greater area than the field-of-view of the user. The continuous sealing member 60 allows for a high sealing efficiency and better leak control, especially when compared with segmented or discontinuous sealing members.

In some embodiments, the helmet can include a breath guard, or breath box. An exemplary breath guard is described in U.S. Pat. No. 11,297,891, titled "HELMET ASSEMBLY WITH VISOR ASSEMBLY HAVING A BREATH GUARD" (Publication No. US 2020-0268090 A1), the content of which is incorporated by reference herein in its entirety. A breath deflector can be provided along the inner surface of the visor 22 for redirecting the breath within the helmet. For example, the user's breath can be deflected/redirected to at least partially avoid contact with the visor 22 to prevent or mitigate fog accumulation thereon. As such, it is appreciated that having a continuous sealing member 60 allows for an improved humidity control within the sealed area 30 and can thus also assist in reducing noise levels created by air infiltrating the helmet through the visor 22. Further, the continuous sealing member can help prevent fogging of the visor 22, when used alone or in combination with a breath box or a breath guard.

Still referring to FIGS. 2 and 3, the visor assembly 20 includes a connection assembly 40, or electrical connection assembly, adapted to provide power to the visor and/or accessories connected to the visor or the helmet (e.g., the heating system 36). In this embodiment, the connection assembly 40 enables connection of a power cable 70 to the visor 22 for providing electrical power to the heating system 36. In this embodiment, the connection assembly 40 is located on the outer surface 26 proximate the front portion 34 of the visor 22 (as seen in FIG. 1), within the periphery defined by the continuous sealing member 60. Therefore, it is noted that the connection assembly 40 is located on a portion of the outer surface 26 within the sealed area 30. It is further noted that providing the connection assembly 40 within the sealed area 30 allows for the sealing member 60 to be continuous around the periphery of the visor since electrical connectors (e.g., wires, cables, etc.) do not have to cross the sealing member for connecting with the heating system 36 located within the sealed area.

Figure 4:
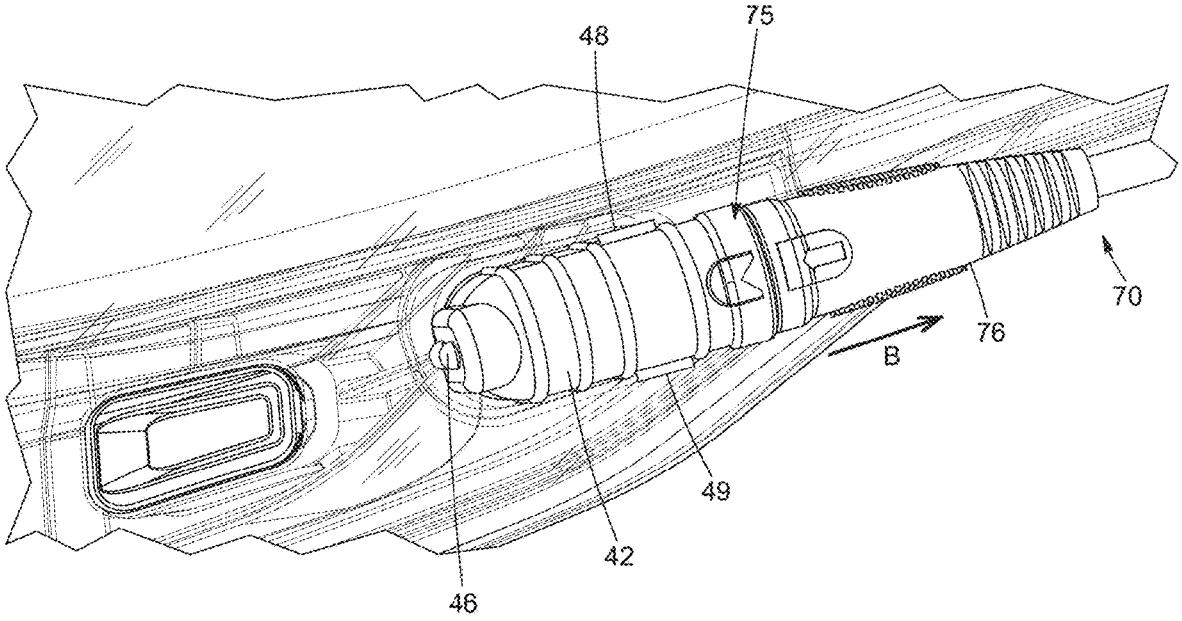
FIG. 4 is an enlarged perspective view of a bottom portion of the visor assembly shown in FIG. 2, showing a power cable coupled to an electrical connector of the connection assembly, according to an embodiment.
Figure 5:
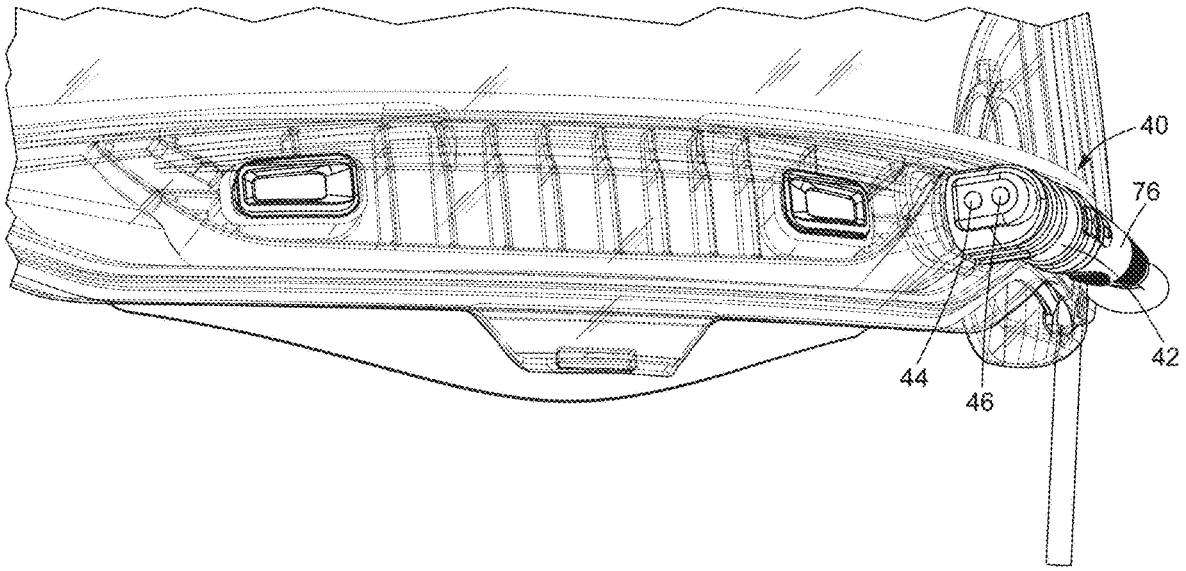
FIG. 5 is a front view of the visor assembly shown in FIG. 2, showing a status indicator connected to the electrical connector of the connection assembly, according to an embodiment.

With reference to FIGS. 4 and 5, the connection assembly 40 includes an electrical connector 42 operatively connectable to the heating system 36 (seen in FIG. 3). The electrical connector 42 can include a connecting end 75 adapted to receive a connection end 76 of the power cable 70. The connecting end 75 can be a female socket 75 adapted to mate with a male connection end 76 of the power cable 70. It should thus be understood that the male and female connectors are adapted to be coupled to one another generally along an axial orientation (e.g., the male and female connectors are axially aligned with one another). The power cable is adapted to transmit power to at least the heating system of the visor assembly. The transmitted power can also be used to power other parts, devices and/or accessories of the helmet and visor assembly, such as a status indicator and a lighting element, both discussed further below.

In some embodiments, the connection assembly 40 can include additional connections configured to transmit power (e.g., provided from the power cable 70 being connected to the electrical connector 42) to the helmet or any other electrical device associated with the visor and/or the helmet. It is noted that additional devices can be provided internally within the helmet, or externally, such as coupled to an outer surface of the helmet or wearable on the user, for instance.

In some embodiments, the connection between the power cable 70 and the connection assembly 40 can be magnetic. For example, the connecting end 75 can include a magnetic connector adapted to connect with a corresponding magnetic connection end of the power cable 70. It should be understood that other methods of connecting the power cable to the connection assembly can be contemplated and used, and that the examples given herein are non-limiting embodiments only. In an embodiment, the connection end 76 of the power cable 70 is shaped and adapted to enable connection and disconnection with a relatively low force generated in a generally axial orientation relative to the connection assembly 40. It should be noted that the axial orientation of the force, and therefore, the axial movement of the connection end 76 relative to the connection assembly 40, can be guided by the male-female configuration of the electrical connection, for example. However, it is appreciated that other connection methods are possible and can be used, such as a connection requiring a rotation, or a combination of various movements, for example.

In some embodiments, the connection assembly 40 further includes a status indicator 44 adapted to visually convey information to the user. For example, the status indicator 44 can convey information, in the form of visual indicators, indicative of the activation status of the heating system. The conveyed information can therefore be indicative of the heating system being powered or unpowered, or of intensities or modes of the heating system, for example and among other possibilities. In some embodiments, the conveyed information can also be indicative of battery level, humidity level and/or temperature inside the helmet, or remaining power time, for example. As seen in FIG. 5, the status indicator 44 can be positioned in a manner to at least partially face the cavity of the helmet shell to enable line of sight of the status indicator 44 by a user wearing the helmet, which correspondingly enables visual confirmation or validation of the visual indicators. Particularly, the status indicator 44 is positioned such that light generated by the status indicator is at least partially in the field of view of the user when the visor assembly 20 is in the lowered configuration (as seen in FIG. 1). The visual indicators of the status indicator 44 can include one or more light-emitting diodes (LED). However, it is appreciated that other devices can be used to provide one or more visual indicators, and that the status indicator 44 can be provided at any other suitable location.

In some embodiments, the connection assembly 40 can also include a control button 48 for controlling the supply of power, for example, being provided to the heating system of the visor assembly. In this embodiment, the control button 48 is operatively connected to the heating system, and can be connected to the status indicator 44 and/or to the electrical connector 42. In operation, the control button 48 allows for controlling activation and deactivation of the heating system. In some configurations, the control button 48 can also be configured to control the heating system in various ways and/or to control the supply of power to other devices and accessories. For example, the control button 48 can control a mode of the heating system, an intensity of the heating system, and/or an intensity of electrical power transmitted to the heating system.

Still referring to FIGS. 4 and 5, the connection assembly 40 can also include a lighting element 46 adapted to project light outwardly from the helmet, such as in front of the user, for example. In some embodiments, the lighting element 46 is adapted to be used as a flashlight by the user. The lighting element 46 can be integrated to the connection assembly 40, thereby avoiding the necessity to install additional components to the helmet, and allowing the projection of the light substantially in front of the user. The lighting element 46 can be a LED such as a High Power LED, operatively connected to the electrical connector 42 and powered by the external power source, although other configurations are possible. For example, the control button 48, or a second auxiliary button 49 can be operatively connected to the lighting element 46 to control the activation and/or the intensity thereof. The lighting element 46 can include a plurality of LEDs provided at any suitable location about the visor and/or the helmet. For instance, a rear-facing LED can be installed on a back side of the helmet to act as an indicator to people behind the user.

Figure 7:
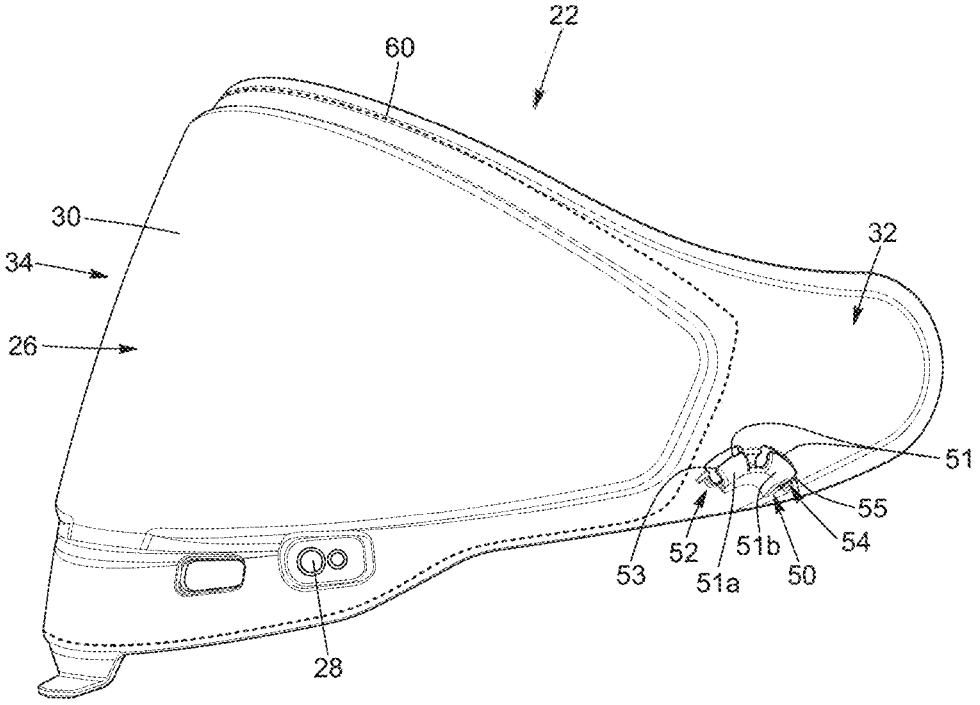
FIG. 7 is a side elevation view of a visor of the visor assembly shown in FIG. 2, showing the cable retaining element and various openings, according to an embodiment.

As shown in FIG. 7, in some embodiments, the visor 22 can include a connection aperture 28 defined therethrough to enable a connection between the connection assembly and a component within the helmet and/or along the inner surface of the visor (e.g., the heating system). The connection aperture 28 is illustratively located within the sealed area 30 so as to enable the connection between the connection assembly 40 and the heating system 36 from within the sealed area. As such, the continuous sealing member 60 can be installed along a periphery of the visor 22, as previously described. In other words, providing an electrical connection within the sealed area 30 prevents having to pass electrical wires through the sealing member 60, for example, from an unsealed area to the sealed area of the inner surface 24 (seen in FIG. 1).

In some embodiments, the heating system can be provided with one or more connection prongs, such that the connection prongs are accessible on the outer surface 26 of the visor 22. The connection assembly can then be adapted to connect directly with the connection prongs, such as by using a magnetic connector to connect with the connection prongs. It should be understood that having connection prongs extending through the visor and along the outer surface causes the connection aperture 28 to be optional. However, it is appreciated that other embodiments and configurations are possible for providing electrical power to the heating system (or to another device or accessory, or to the helmet) through the visor, and without going through the sealing member 60.

Figure 6:
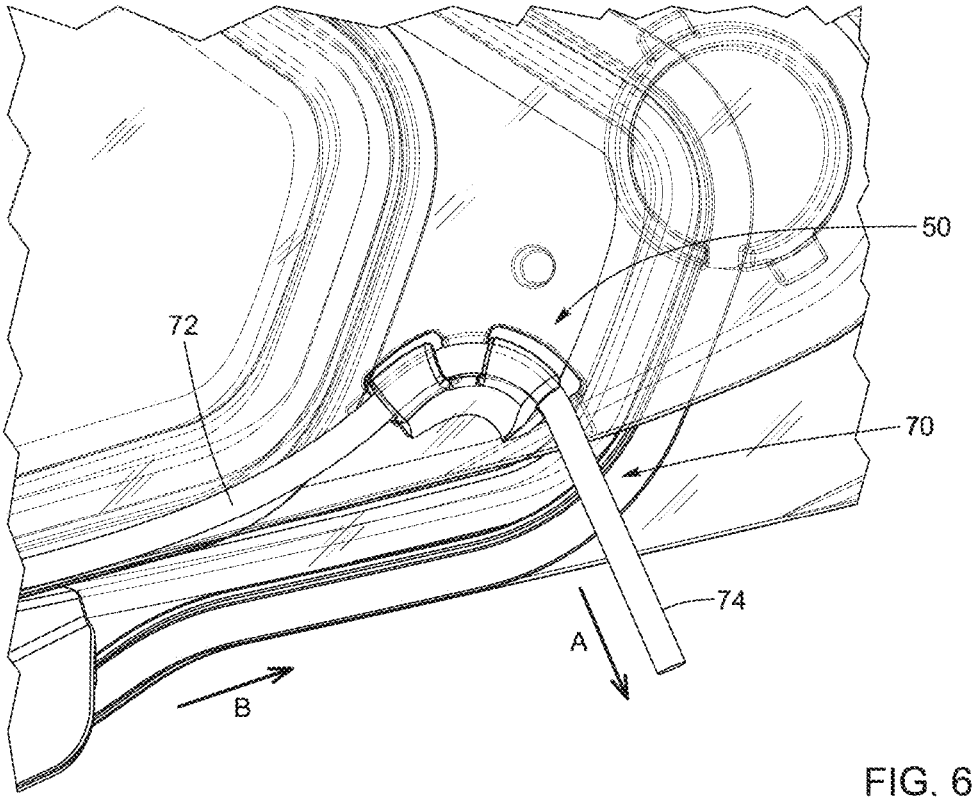
FIG. 6 is an enlarged view of a portion of the visor assembly shown in FIG. 2, showing a cable retaining element, according to an embodiment.

Now referring to FIGS. 5, 6 and 7, the helmet includes a cable retaining element 50 located on the outer surface 26 of the visor 22. The cable retaining element 50 includes at least one clip 51 adapted to removably attach the power cable 70 on said visor 22. In some embodiments, the cable retaining element 50 is located proximate one of the left and right visor mounting sections 32, such as out of the user's field-of-view. Further, as illustrated, the cable retaining element 50 is located on a portion of the outer surface 26 corresponding to the outside of the sealed area 30 defined by the sealing member 60. In other words, the cable retaining element 50 is shaped and formed on the outer surface 26 of the visor 22, outside of the sealed area 30. The cable retaining element 50, and therefore the at least one clip 51, can be integrated to the visor, and together form a one-piece unit. As such, it is noted that the at least one clip can protrude from the outer surface of the visor.

The cable retaining element 50 allows for improved management of the power cable 70. As will be described further below, the cable retaining element 50 at least partially prevents potential damages that can be sustained by the connection assembly 40, when the power cable 70 is accidentally tugged on or ripped away from the helmet. Furthermore, the cable retaining element 50 allows for reducing bending or straining the connection assembly 40, and associated parts, when moving the visor between the lowered configuration and the at least one raised configuration. It should be understood that, as used herein, the expression "straining" can refer to a physical force (e.g., shear, axial, rotative, bending, etc.) sustained by the connection assembly 40. The cable retaining element 50 can also be adapted to provide an improved control of the power cable 70 when the visor 22 is moved relative to the helmet shell, such as by limiting undesired movement of the power cable 70 relative to the helmet. The cable retaining element 50 can also be adapted to reduce free movements of the portion of the power cable 70 held within the cable retaining element 50. It should be noted that the cable retaining element 50 allows for using a power cable having a desired and/or optimized length, and can thus remove the need for a buffer length of cable to enable relative movement between the visor 22 and the helmet shell 10.

In this embodiment, the clip 51 of the cable retaining element 50 includes a first portion 52 having a first end 53, and a second portion 54 having a second end 55 The first portion 52 extends in a first direction that is substantially oriented or aligned toward the connection assembly 40 such that a first section 72 of the power cable 70, coupled to the first portion 52 and extending from the first end 53 of the clip 51, extends toward the front portion of the visor 22 and is in general alignment with the electrical connector 42. As the first section 72 of the power cable 70 includes the connection end 76, said connection end 76 is therefore generally oriented with the electrical connector 42. This configuration at least partially prevents or at least reduces the risks of damaging one or both of the electrical connector 42 and the connection end 76 when forces, such as transverse or radial forces relative to the electrical connector, are applied to the power cable 70.

For example, and with reference to FIGS. 6 and 7, when a force A is applied to a second section 74 of the power cable 70 extending from the second portion 54 of the clip 51, notwithstanding the orientation of the force, the first portion 52 holds the first section 72 in position such that the force A applied to the second section 74 is generally translated into an axial force B onto the first section 72 of the power cable 70. As previously described, the electrical connector 42 is adapted to connect with the connection end 76 generally along an axial orientation. As such, the translated axial force B can simply result in a disconnection of the power cable 70 (e.g., without harming/damaging the components the power cable and/or the connection assembly).

Still referring to FIGS. 5 to 7, the clip 51 generally defines a hook-shaped channel adapted to receive the power cable 70. For example, the power cable 70 can be slidably connected to the clip 51, or resiliently pushed into the clip 51. In some embodiments, the channel defines an arcuate shape, such that the first end 53 of the first portion 52 is oriented in the first direction while the second end 55 of the second portion 54 is oriented in a second direction, angled relative to the first direction. The arcuate shape defined by the clip 51 allows for redirecting the power cable 70 into the general alignment with the electrical connector 42, therefore reducing stress or strain on the connection assembly 40 when a force is applied to the power cable 70. The second section 74 of the power cable extends along the second direction, which can be oriented toward the power source, for example.

In some embodiments, a power source for powering the heating system 36 can be located downward from the helmet worn by the user. For instance, the power source can include the battery of the ridden vehicle (e.g., snowmobile, motorcycle, etc.). In some configurations, the power source can be located behind the helmet, such as a battery attached to a rear-facing portion of the helmet or within a backpack worn by the user, among other possibilities. In any case, the portions of the clip 51 are oriented such that the power cable 70 is redirected from the second section 74 to the first section 72 to be aligned with the electrical connector 42.

The second section 74 of the power cable 70 can be connected directly to the power source. In some embodiments, the second section 74 has a second connecting end 75 for connecting with an auxiliary cable, where the auxiliary cable is connected to the power source. This configuration allows further damage prevention for the connection assembly 40, and for the cable retaining element 50, as the second section 74 can simply be disconnected from the auxiliary cable when a disconnection force is applied to the auxiliary cable.

In this embodiment, the clip 51 can be further adapted to generate a friction force on the power cable 70, such as when a disconnection force, or a ripping force, is applied to the power cable 70. For example, an inside face of the clip 51 can have a rugged pattern or can be provided with a material having a high friction coefficient, helping in dissipating the energy created by the force applied to the power cable 70. In some embodiments, the clip 51 can have a diameter smaller than a diameter of the power cable 70 to at least partially compress the power cable 70, such that friction is generated on the power cable 70, for example, when a ripping/disconnection force is applied. Accordingly, the applied force is translated into an axial force relative to the electrical connector 42, and the magnitude of the force is also reduced. This further reduces or prevents potential and/or accidental damage to the connection assembly 40.

In some embodiments, as seen in FIGS. 6 and 7, the cable retaining element 50 includes first and second clips 51*a*, 51*b* (or the clip 51 includes first and second clip portions 52, 54), the first clip 51*a* having the first end 53 and the second clip 51*b* having the second end 55. The first and second clips 51*a*, 51*b* can both define hook-shaped channels adapted to receive the power cable 70. The channels together can define the arcuate shape of the clip 51, where the first end 53 and the second end 55 extend in the first and second directions, respectively. The second clip 51*b* can be adjacent, proximate to or spaced apart from the first clip 51*a*, as desired. Other embodiments of the cable retaining element 50 can be used, where the cable retaining element includes additional clips or clip sections, and defines other shapes adapted to receive the power cable 70.

In some embodiments, the cable retaining element 50 can be mounted to the visor 22 instead of integrated to it. For example, the cable retaining element 50 can be secured to the visor 22 with fasteners such as screws, rivets, fastening agents, adhesive(s) or a combination thereof. In such cases, the cable retaining element 50 can be made from a resilient material different from the material of the visor 22, such as to facilitate attaching the power cable 70 on the visor 22 by using a material that can be temporarily deformed when inserting the power cable 70 into the channel of the clip 51.

It should be appreciated from the present disclosure that the various embodiments of the helmet, visor assembly, and related components enable electrically powering the visor assembly. The connection assembly, located toward the front of an outer surface of the visor, is adapted to enable connection with one or more electrical systems, such as the heating system. The powered visor assembly can be further electrically coupled to other components, such as additional accessories (lights, cameras, etc.) or to the helmet to provide electrical power thereto. The sealing member of the visor is continuous, with the connection assembly being located within a periphery defined by the sealing member to prevent wiring, or other components, from extending through the seal defined by the sealing member.

The cable retaining element located on the outer surface of the visor includes a clip for receiving and holding the power cable used to connect with and provide power to the connection assembly. The clip allows for removably attaching the power cable to the visor and is adapted to redirect the power cable into general alignment with the connection assembly, thereby preventing, or at least partially reducing damages to the connection assembly and/or the power cable, e.g., when forces are applied to the power cable.

The present disclosure may be embodied in other specific forms without departing from the subject matter of the claims. The described example embodiments are to be considered in all respects as being only illustrative and not restrictive.

In the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Furthermore, it should be understood that while the various embodiments described herein are made in relation to a snowmobile helmet, those embodiments can be adapted to other types of helmets. Therefore, the use of the term "helmet" is not meant to be limiting to a type of helmet. For example, the embodiments could be adapted to motorcycle helmets, bicycle helmets, and so on. In addition, while the various optional embodiments described herein and depicted in the drawings define certain configurations and components, it should be understood that not all such configurations and elements are essential. Therefore, the embodiments described should not be taken in a limiting scope and only as exemplary configurations.

The present disclosure intends to cover and embrace all suitable changes in technology. The scope of the present disclosure is, therefore, described by the appended claims rather than by the foregoing description. The scope of the claims should not be limited by the embodiments set forth in the examples, but should be given the broadest interpretation consistent with the description as a whole.

As used herein, the terms "coupled", "coupling", "attached", "connected" or variants thereof as used herein can have several different meanings depending on the context in which these terms are used. For example, the terms coupled, coupling, connected or attached can have a mechanical connotation. For example, as used herein, the terms coupled, coupling or attached can indicate that two elements or devices are directly connected to one another or connected to one another through one or more intermediate elements or devices via a mechanical element depending on the particular context.

In the present disclosure, an embodiment is an example or implementation of the described features. The various appearances of "one embodiment," "an embodiment" or "some embodiments" do not necessarily all refer to the same embodiments. Although various features may be described in the context of a single embodiment, the features may also be provided separately or in any suitable combination. Conversely, although the helmet and/or the visor mounting system may be described herein in the context of separate embodiments for clarity, it may also be embodied in a single embodiment. Reference in the specification to "some embodiments", "an embodiment", "one embodiment", or "other embodiments", means that a particular feature, structure, or characteristic described in connection with the embodiments is included in at least some embodiments, but not necessarily in all embodiments.

In addition, although the optional configurations as illustrated in the accompanying drawings comprises various components and although the optional configurations of the helmet as shown may consist of certain geometrical configurations as explained and illustrated herein, not all of these components and geometries are essential and thus should not be taken in their restrictive sense, i.e., should not be taken as to limit the scope of the present disclosure. It is to be understood that other suitable components and cooperation thereinbetween, as well as other suitable geometrical configurations may be used for the embodiment and use of the helmet, and corresponding parts, as briefly explained and as can be easily inferred herefrom, without departing from the scope of the disclosure.

The invention claimed is:

1. A visor assembly of a helmet having a helmet shell defining a cavity, the visor assembly comprising:

a visor pivotally connectable to the helmet shell and provided with a heating system operable for heating at least one surface of the visor;

a sealing member extending across the at least one surface of the visor to define a sealed area thereon; and an electrical connector provided within the sealed area on the visor on a surface opposite the heating system, the visor being provided with an aperture defined within the sealed area to enable establishing a connection between the electrical connector and the heating system.

2. The visor assembly of claim 1, wherein the sealing member is continuous and extends along a periphery of the visor.

3. The visor assembly of claim 1, further comprising a status indicator adapted to visually display a status indicative of an activation of the heating system, the status indicator being operatively connected to the electrical connector and located toward a front portion of the visor in order to be in line of sight of a user wearing the helmet when the visor is in a lowered position.

4. The visor assembly of claim 3, wherein the status indicator is provided on an exposed surface of the electrical connector.

5. The visor assembly of claim 3, further comprising a lighting element operatively connected to the electrical connector and operable to project light outwardly from the helmet.

6. The visor assembly of claim 5, further comprising a cable retaining element located on the visor and adapted to removably attach a power cable on the visor, the power cable being configured to be connected to the electrical connector to provide electrical power to at least one of the heating system, the status indicator and the lighting element.

7. The visor assembly of claim 6, wherein the cable retaining element is located on the outer surface of the visor outside of the sealed area.

8. The visor assembly of claim 1, further comprising a cable retaining element located on the visor to enable removably attaching a power cable on the visor, the power cable being configured to be connected to the electrical connector to provide electrical power to the heating system, the cable retaining element comprising a first portion extending in a first direction substantially oriented toward the electrical connector such that the power cable coupled to the cable retaining element has a portion extending from the first portion of the cable retaining element in general alignment with the electrical connector such that a disconnection force applied to the power cable is reoriented by the cable retaining element to define a force axially aligned with the electrical connector in order to at least partially prevent damaging at least one of the power cable, the electrical connector and the visor.

9. The visor assembly of claim 8, wherein the cable retaining element comprises a second portion extending in a second direction at an angle relative to the first direction such that the first portion and the second portion cooperate to define an arcuate channel adapted to receive and redirect the power cable into the general alignment with the electrical connector.

10. The visor assembly of claim 9, wherein the first portion and the second portion of the cable retaining element are spaced from one another.

11. The visor assembly of claim 8, wherein the cable retaining element comprises a resilient hooked-shaped clip configured to enable laterally and removably inserting the power cable therein.

12. The visor assembly of claim 8, wherein the cable retaining element is integrated to the visor to form a one-piece unit.

13. The visor assembly of claim 8, wherein the cable retaining element is removably connectable to the visor.

14. The visor assembly of claim 8, wherein the cable retaining element is located on the outer surface of the visor outside of the sealed area.

15. The visor assembly of claim 1, further comprising a cable retaining element integrated to the visor to form a one-piece unit therewith and having a clip adapted to removably attach a power cable on the visor, the power cable being configured to be connected to the electrical connector to provide electrical power to the heating system.

16. The visor assembly of claim 15, wherein the clip comprises clip portions configured to redirect the power cable from a power source towards the electrical connector.

17. The visor assembly of claim 16, wherein at least one of the clip portions is hooked-shaped and resilient to enable clipping the power cable therein.

18. The visor assembly of claim 15, wherein the cable retaining element is located on the outer surface of the visor outside of the sealed area.

19. The visor assembly of claim 1, wherein the electrical connector is magnetic and configured to enable magnetically connecting a power cable thereto, the power cable being configured to be connected to the electrical connector to provide electrical power to the heating system.

20. A helmet, comprising:

a helmet shell defining a cavity and having a front opening; and the visor assembly of claim 1, the visor being adapted to cover the front opening of the helmet shell.

* * * * *